US005545433A

United States Patent [19]

Aanestad

[11] Patent Number: 5,545,433

[45] Date of Patent: Aug. 13, 1996

[54] METHOD FOR PRECIPITATION COATING OF INTERNAL SURFACES IN TANKS AND PIPE SYSTEMS

[76] Inventor: Leif I. Aanestad, Hanabakken 14, N-4300 Sandnes, Norway

[21] Appl. No.: 338,593

[22] PCT Filed: May 10, 1993

[86] PCT No.: PCT/NO93/00073

§ 371 Date: Nov. 15, 1994

§ 102(e) Date: Nov. 15, 1994

[87] PCT Pub. No.: WO93/23588

PCT Pub. Date: Nov. 25, 1993

[30] Foreign Application Priority Data

May 18, 1992 [NO] Norway ..... 921956

[51] Int. Cl.[6] ..... B05D 7/22

[52] U.S. Cl. ..... 427/230; 427/239; 427/304; 427/305; 427/328; 427/345; 427/437; 427/443.1

[58] Field of Search ..... 427/239, 304, 427/230, 328, 345, 305, 443.1, 443.2, 437

[56] References Cited

FOREIGN PATENT DOCUMENTS

| | | |
|---|---|---|
| 0043356 | 1/1982 | European Pat. Off. . |
| 0380169 | 8/1990 | European Pat. Off. . |
| 1521362 | 7/1969 | Germany . |
| 2815761 | 10/1979 | Germany . |
| 0330837 | 8/1958 | Sweden . |
| 1209037 | 10/1970 | United Kingdom . |
| 1399645 | 7/1975 | United Kingdom . |
| 2058140 | 9/1979 | United Kingdom . |

OTHER PUBLICATIONS

Patent Abstracts of Japan, vol. 12, No. 237, C–509, abstract of JP, A 63–26376. Feb. 3, 1988.

*Primary Examiner*—Janyce Bell
*Attorney, Agent, or Firm*—Stanley A. Marcus

[57] ABSTRACT

A method and an apparatus for coating tanks and pipe systems internally in that, first, a tank (1) is filled with a liquid (3) consisting of water to which is admixed an acid (10). Oxide coating on the internal surface is removed through heating and circulating the liquid (3) through a filter (4). The liquid (3) is neutralized through the admixture of a base (12). Approximately one fifth of the neutralized liquid (3) is drawn off, the tank (1) being refilled with a concentrated metal solution (15). The temperature, acidity and metal concentration of the liquid (3) are maintained close to constant through supplying heat, acid (10) or base or base (12), and concentrated metal solution (15), respectively. Air or vapor is supplied through a blowing pipe (5) and creates stirring, surplus liquid and gas being drained through a pipe (16). When the internal surface of the tank (1) has received a coating having the desired thickness, the process is interrupted in that the liquid (3) is cooled and drained.

10 Claims, 1 Drawing Sheet

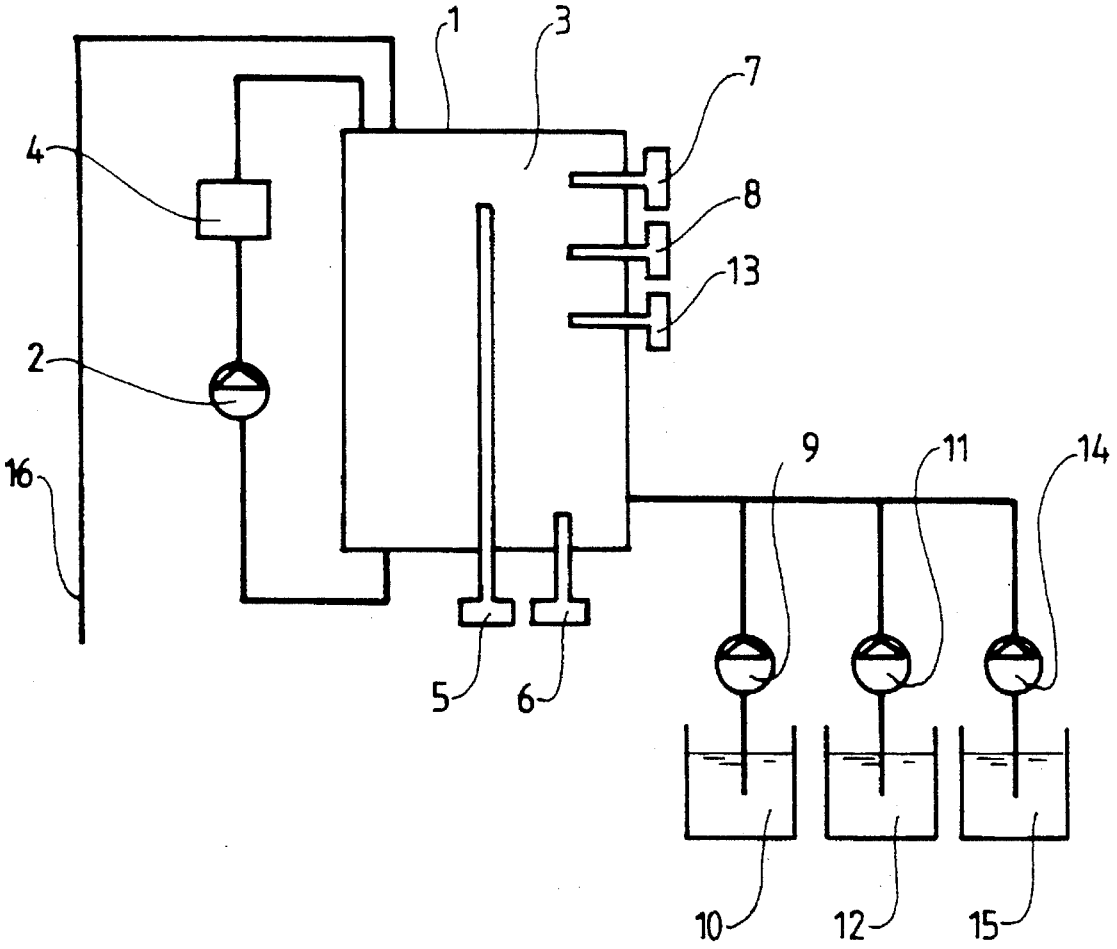
1
3
7
4
8
13
2
9
11
14
16
5
6
10
12
15

METHOD FOR PRECIPITATION COATING OF INTERNAL SURFACES IN TANKS AND PIPE SYSTEMS

The invention relates to a method and an apparatus for precipitation coating of internal surfaces in tanks and pipe systems.

Usually, coating of internal surfaces in tanks and pipe systems has the purpose of protecting the base material against corrosion or mechanical wear and tear. In some cases it is desirable to protect the content of tanks and pipes, such as foodstuffs, against undesirable effects from the base material.

A coating may be applied in a plurality of ways. As known, paint is applied by means of a brush, a roller or a sprayer. Metal coating is e.g. applied through thermical spraying, through electrolysis or through precipitation of metals from a metal solution. Also, various forms of applying metal vapour in vacuum are known.

On a base material such as steel, metal coatings of e.g. chrome and nickel alloys are preferred for corrosion protection and resistance to wear and tear. Where a particularly large resistance to wear and tear is required, coatings of various carbides are used.

When immerging an object into a metalliferous solution, metal can precipitate on the surface of the object. In order to achieve a plain and smooth precipitation, temperature, acidity and concentration must be controlled. Good preliminary work, such as cleaning and removal of oxide coating, is important in order to obtain good adherence to the base material. The treatment may involve immersion into up to tens of baths having different chemical composition. When the object is moved from one bath to the next, the surface thereof is often very reactive. One has to work such that corrosive attacks do not arrise when the object is out of the baths.

Chemical coating through precipitation is difficult to accomplish on very large objects, i.a. because it requires many and large vessels to immerse the object into. Repair treatment involving disassembling, transport and immersion of tanks of e.g. two hundred cubic meters, is nearly unthinkable with prior art technique.

An object of the invention is to provide a method and an apparatus for precipitation coating of internal surfaces in tanks and pipe systems without immersion into vessels. Also, it is an object that surfaces to be coated are not subjected to corrosive environment between the various steps of the process.

The objects are achieved in that the object to be coated internally is filled with a liquid, the chemical composition, acidity and temperature thereof being varied. This replace the various steps of the immersion process. The surface to be coated undergoes approximately the same stages as in immersion into several vessels containing different chemicals.

BRIEF DESCRIPTION OF THE DRAWING

The drawing illustrates an embodiment of the invention whereby an electroless metal coating is applied to the inside of a tank.

The invention is described with reference to the enclosed figure, and with a starting-point of a tank of steel to be coated internally with e.g. a nickel alloy of a type known.

One embodiment of such a nickel alloy is nickel-phosphorous.

In the figure of the drawing, 1 denotes a tank where a first pump 2 is adapted to circulate a liquid into the tank through a filter 4. A blowing pipe 5 is adapted to supply gas or vapour to the liquid 3 for stirring purposes. One or more heating elements 6 are adapted to heat the liquid 3, and one or more thermometers 7 record the temperature of the liquid 3. A pH-meter 8 records the acidity of the liquid 3. A second pump 9 is adapted to pump acid 10 into the tank 1. A third pump 11 is adapted to pump a base 12 into the tank 1. A sensor 13 measures the concentration of dissolved metal in the liquid 3, and a fourth pump 14 is adapted to pump a concentrated metal solution 15 into the tank 1. Surplus liquid and gas are drained from the tank 1 through a drain pipe 16.

The tank 1 is assumed to be cleaned prior to the treatment commences. The tank 1 is coated internally in that metal dissolved in the liquid 3, in a manner known per se, is precipitated on the internal surface of the tank 1.

First, the tank 1 is filled with water to which is added acid 10 in order to remove oxides from the surface to be coated. For the cleaning of steel, very often an admixture of two to five percent concentrated sulphuric acid will be sufficient. The acid 3, now being acid, is heated and circulated through the filter 4 by means of first pump 2. When the internal surface of the tank 1 is cleaned, the liquid 3 is neutralized through the admixture of a base 12, e.g. ammonia, by means of third pump 11. When the liquid 3 has reached a pH equal to seven, approximately one fifth of the liquid 3 is drawn off, and the tank 1 is refilled with a concentrated metal solution 15 by means of the pump 14. When blowing air into the blowing pipe 5, stirring is effected in the liquid 3, which is heated to the temperature specified for the actual solution. Heating element 6 and thermometer 7 are used in order to maintain a constant or approximately constant temperature. The acidity of the liquid 3 is maintained close to four point seven in that acid 10 or base 12 is admixed by means of second and third pump 9, 11. The metal concentration of the liquid 3 is maintained close to constant in that metal solution 15 is pumped into the tank 1 in step with metal being precipitated. How fast metal is precipitated depends on temperature, acidity and concentration of dissolved metal in the liquid 3. It is important to control these parameters such that the coating formed receives the intentional properties. Actual values are found in data papers for the metal solution used. The thickness of the coating on the internal surface of the tank 1 may e.g. be controlled from the outside by means of known ultrasonic technique. Also, within the tank 1, metal samples may be suspended, which are withdrawn and analyzed gradually as the process operates. When the coating has received the desired thickness, the process is interrupted in that the liquid 3 is cooled down and drawn off. Dissolved metal may be recovered, e.g. through inverted osmosis filtration.

In order to achieve a better temperature control, the air blown into the liquid 3 may be preheated. Aqueous vapour may possibly be used. The liquid 3 will be cooled at the walls of the tank 1, and stirring using air or steam as well as supply of heat are adapted such that the desired precipitation is obtained. Therefore, the arrangement of several heating elements 6 and temperature sensors 7 may be necessary for selective temperature control within selected areas of the tank 1. Likewise, the blowing pipe 5 should be designed such that the desired stirring effect is achieved. Using several blowing pipes 5, selective stirring can be obtained within selected areas of the tank 1. Stirring may also be effected by means of other known technique, such as rotary paddle wheels, injection of jet streams into liquid and the like.

I claim:

1. A method for applying a metal coating to the internal, cleaned surfaces of tanks and pipe systems comprising the steps of (a) filling the tank or pipe system with an aqueous solution of an acid;

(b) cleaning the surfaces to be coated by heating the acid solution, circulating it throughout the tank or pipe system and removing particulates from the hot acid solution;

(c) neutralizing the acid solution at the end of the cleaning step;

(d) removing about one-fifth of the volume of neutralized solution and replacing it with a concentrated metal plating solution;

(e) circulating the resultant solution to coat the internal surfaces of the tank or pipe system with metal.

2. A method according to claim 1 which includes the step of replenishing the metal content in the circulating metal-plating solution.

3. A method according to claim 1 in which the metal coating is nickel-phosphorous.

4. A method according to claim 3 which includes the step of replenishing the nickel content in the circulating nickel-phosphorous plating solution.

5. A method according to claim 1, for coating steel tanks and pipe systems with a metal coating in which the cleaning solution comprises aqueous sulfuric acid, the neutralizing agent comprises ammonia and the concentrated metal planting solution comprises a nickel-phosphorous solution.

6. The method of claim 5 which includes the step of replenishing the nickel content in the circulating nickel plating solution.

7. A method for applying a nickel coating to the internal surfaces of a vessel including the steps of (a) filling the vessel with an aqueous solution of an acid;

(b) cleaning the surfaces to be coated with nickel by heating the acid solution, circulating it throughout the vessel and removing particulates from the hot acid solution;

(c) neutralizing the acid solution at the end of the cleaning step by adding a base to the acid solution;

(d) removing about one-fifth of the volume of neutralized solution and replacing it with a concentrated nickel plating solution to fill the vessel back up; and (e) circulating the resulting solution to coat the internal surfaces of the tank with nickel.

8. The method of claim 7 in which the nickel coating is nickel-phosphorous.

9. The method of claim 7 in which the base is ammonia.

10. The method of claim 7 in which the acid is sulfuric acid.

* * * * *